United States Patent [19]

Arimoto et al.

[11] Patent Number: 4,475,018

[45] Date of Patent: Oct. 2, 1984

[54] PUFFER TYPE GAS CIRCUIT BREAKER

[75] Inventors: Satomi Arimoto, Nishinomiya; Hiroshi Kakeyama, Ashiya, both of Japan

[73] Assignee: Mitsubishi Denki Kabushiki Kaisha, Japan

[21] Appl. No.: 450,202

[22] Filed: Dec. 16, 1982

[30] Foreign Application Priority Data

Dec. 22, 1981 [JP] Japan ..... 56-208647

[51] Int. Cl.[3] ..... H01H 33/00

[52] U.S. Cl. ..... 200/148 R; 200/148 A; 200/150 G

[58] Field of Search ..... 200/148 A, 148 R, 150 G

[56] References Cited

U.S. PATENT DOCUMENTS

| | | | |
|---|---|---|---|
| 4,139,752 | 4/1976 | Itai et al. | 200/148 R |
| 4,228,332 | 3/1978 | Ibuki et al. | 200/148 R |
| 4,259,556 | 3/1978 | Kii | 200/148 R |
| 4,270,034 | 3/1978 | Kii | 200/148 R |
| 4,393,291 | 7/1983 | Stewart et al. | 200/148 A |

*Primary Examiner*—E. A. Goldberg
*Assistant Examiner*—Morris Ginsburg
*Attorney, Agent, or Firm*—Leydig, Voit, Osann, Mayer and Holt, Ltd.

[57] ABSTRACT

The present invention relates to a puffer type gas circuit breaker wherein, in order to efficiently extinguish an electric arc struck when a movable arc contact is disengaged from a stationary arc contact, self-extinction by an arc extinguishing fluid in a gas storage chamber is performed conjointly with forced extinction by an arc extinguishing fluid in a puffer chamber, in accordance with the movement of the movable arc contact.

5 Claims, 12 Drawing Figures

PUFFER TYPE GAS CIRCUIT BREAKER

BACKGROUND OF THE INVENTION

This invention relates to a puffer type gas circuit breaker.

A prior-art, puffer type gas circuit breaker has been constructed as shown in FIGS. 1*a* and 1*b*. FIG. 1*a* illustrates the closed contact state of the prior-art, puffer type bidirectional-gas-blast circuit breaker, while FIG. 1*b* illustrates the open contact state of the circuit breaker.

Referring to the figures, numeral 1 designates a terminal plate on a power supply side, and numeral 2 a terminal plate on a load side. Numeral 3 designates a current-carrying stationary contact on the power supply side, which is attached at one end thereof to the terminal plate 1, the other end of which is constructed by annularly arraying a plurality of finger contacts, and which is brought into sliding contact with or disengage from a puffer cylinder 4 to be described below. The puffer cylinder 4 also serves as a current-carrying movable contact, and moves in relation to a rod 6 to be described below. Shown at numeral 5 is a current-carrying stationary contact on the load side, which is attached at one end thereof to the terminal plate 2, the other end of which has a plurality of finger contacts arrayed annularly, and which is brought into sliding contact with or disengaged from the puffer cylinder 4. The rod 6 is driven in the axial direction thereof by a driving mechanism, not shown, through an insulating rod, not shown. The rod 6 is formed at one end thereof with an opening 61 and at the other end thereof with communicating holes 62 which are formed perpendicular to the axial direction thereof, as well as being fixed at said one end to a supporter 7. A finger-shaped movable arc contact 8 is also fixed to the supporter 7. A cylindrical stationary arc contact 9 which can be brought into and out of contact with the movable arc contact 8, has gas holes 91 and 92 formed at both of its ends, and is fixed at one end thereof to the terminal plate 1. The terminal plate 1 is formed with a gas hole 100, which communicates with the gas hole 91 of the stationary arc contact 9.

Shown at numeral 10 is a puffer piston. A puffer chamber 11 is defined by the puffer piston 10, the puffer cylinder 4, the supporter 7 and the rod 6. Numeral 12 indicates a fluid guide which is made of an insulating material such as teflon, which is arranged coaxially and concentrically with the stationary arc contact 9, and which is fixed to the rod 6 through the supporter 7. Numeral 13 indicates a fluid guide which is also made of an insulating material such as teflon, which is arranged coaxially and concentrically with the stationary arc contact 9, and which is fixed to the rod 6 in a manner to surround the movable arc contact 8. Both the fluid guides 12 and 13 are respectively formed with openings 121 and 131 so that the stationary arc contact 9 can be snugly inserted therethrough. The supporter 7 has communicating holes 71 formed therein. As will be described later, an arc extinguishing fluid (for example, $SF_6$ gas) contained in the puffer chamber 11 passes through the communicating holes 71 at a low temperature and becomes a high speed, high pressure gas stream approaching the speed of sound and circulates through a passage 14 defined by both the fluid guides 12 and 13, whereupon the fluid is forcibly blown against an electric arc 15 via a nozzle 141, 131 formed in the fluid guides 12 and 13, respectively.

The operations of then prior art gas circuit breaker will be explained hereinafter.

Under the closed contact state shown in FIG. 1*a*, current flows from the power supply side terminal plate 1 to the load side terminal plate 2 via the stationary contact 3, puffer cylinder (movable contact) 4 and stationary contact 5 in the order mentioned. In addition, part of the current flows from the power supply side terminal plate 1 to the load side terminal plate 2 via the stationary arc contact 9, movable arc contact 8, supporter 7, puffer cylinder (movable contact) 4 and stationary contact 5 in the order mentioned.

Next, when the contacts are opened, as illustrated in FIG. 1*b*, the rod 6 is caused to descend by an insulating rod connected therewith, not shown, which is connected to a driving mechanism, not shown. With the downward movement of the rod 6, the puffer cylinder 4 simultaneously moves downward, so that the arc extinguishing fluid in the puffer chamber 11 is forcibly compressed. The arc extinguishing fluid at the low temperature compressed forcibly flows into the passage 14 via the communicating holes 71 as indicated by arrows a. Part of the arc extinguishing fluid is discharged into a container (not shown), filled with the fluid, along a path indicated by arrows b, c, d, e and f by passing through the opening 131 of the fluid guide 13, the opening 61 of the rod 6, the interior of the rod 6 and the communicating holes 62 of the rod 6 in the order mentioned. Another part of the arc extinguishing fluid is discharged through the gas hole 92 of the stationary arc contact 9 into the container (not shown) along a path indicated by arrows g, h, i and j by passing through the interior and gas hole 91 of the stationary arc contact 9 and the gas hole 100 of the terminal plate 1. Further, another part is discharged from the opening 121 of the fluid guide 12 into the container (not shown) as indicated by an arrow k.

The electrical interrupting operation will be generally explained hereinafter.

When the rod 6 descends, the puffer cylinder or movable contact 4 is first disengaged from the stationary contact 3. The movable arc contact 8 is subsequently disengaged from the stationary arc contact 9, so that the electric arc 15 develops between the movable arc contact 8 and the stationary arc contact 9. The arc 15 is extended downward with the descent of the movable arc contact 8, while at the same time the low temperature gas stream from the puffer chamber 11 is forcibly blown against the arc 15 at a velocity approaching the speed of sound. Thus, the foot 151 of the arc 15 on the power supply side is forcibly moved toward the terminal plate 1, and the foot 152 on the load side is forcibly moved toward the terminal plate 2. In addition, the arc 15 is bilaterally extended within the stationary arc contact 9 at one end thereof and within the movable arc contact 8 and rod 6 at the other end thereof. In this way, the arc 15 is lengthened to increase its resistance, so that the arc current is limited. Further, the arc is exposed to the low temperature arc extinguishing fluid travelling at a high speed and having a high insulating property. Consequently, the thermal energy of the arc is absorbed and consumed by this arc extinguishing fluid. Thus, the arc 15 is extinguished at the zero current point for the case of alternating current or by the current limitation for the case of direct current. Further, the current is quickly interrupted due to insulating properties of the arc extinguishing fluid.

The prior-art puffer type gas circuit breaker, constructed and operated as described above has the following disadvantages. When the current to be interrupted is great, the internal space in the nozzle 141 is occupied by the arc. A pressure rise near the nozzle attributed to the heat generated by the arc becomes greater than the pressure of the puffer chamber 11, which causes the arc extinguishing fluid from the puffer chamber 11 to be confined in the nozzle 141, and the so-called "exhaustion phenomenon" takes place in which the contact opening speed of the movable contact is reduced for positions near the full opening stroke. When the thermal energy produced by the arc is still greater, the thermal energy flows backward from the passage 14 to the puffer chamber 11 (this phenomenon is termed "arc-back") and causes the pressure to rise in the puffer chamber 11, which causes the "exhaustion phenomenon" to worsen. FIG. 2 elucidates the occurrence of the above "exhaustion phenomenon", in which dotted lines indicate characteristics in the no-load state where no current flows, and solid lines indicate characteristics in the so-called loaded state of interrupting a short-circuit current. In the figure, curves $P_1$ and $P_2$ denote the pressure rises of the puffer chamber, curves $S_1$ and $S_2$, the contact opening strokes (displacements) of the movable contact, and a curve I the short-circuit current. As seen from the figure, under the loaded state, the pressure rise of the puffer chamber becomes approximately double, and the contact opening speed becomes slower near the position of the full opening stroke. That is, the "exhaustion phenomenon" is noted. In the light of this fact, an increase in the power of an operating drive force becomes necessary for eliminating the "exhaustion phenomenon". In this manner, as the interrupting capacity of the circuit breaker is increased, the thermal energy produced by the arc increases, and the "confinement phenomenon" and "exhaustion phenomenon" described above become more noticable, so that the operating drive force requires increasingly greater power. For example, in a circuit breaker whose short-circuit current is several tens kA, the load on the operating rod in the loaded state, attributed to the "confinement phenomenon", becomes several tons (per arc extinguishing chamber) greater than that in the no-load state.

SUMMARY OF THE INVENTION

The present invention has been made in view of the foregoing, and has for its object to provide a puffer type gas circuit breaker wherein a fluid rendered high in temperature and high in pressure by the generation of an electric arc is mixed with a fluid in a gas storage chamber and then stored in this chamber, a fluid in a puffer chamber is ejected against the arc, and after a movable arc contact has moved a predetermined distance, the fluid of the gas storage chamber is ejected against the arc together with the fluid of the puffer chamber, whereby an operating drive force can be lessened.

BRIEF DESCRIPTION OF THE DRAWINGS

In the drawings, the same symbols indicate the same or corresponding parts.

DESCRIPTION OF THE PREFERRED EMBODIMENTS

Figure 1A:
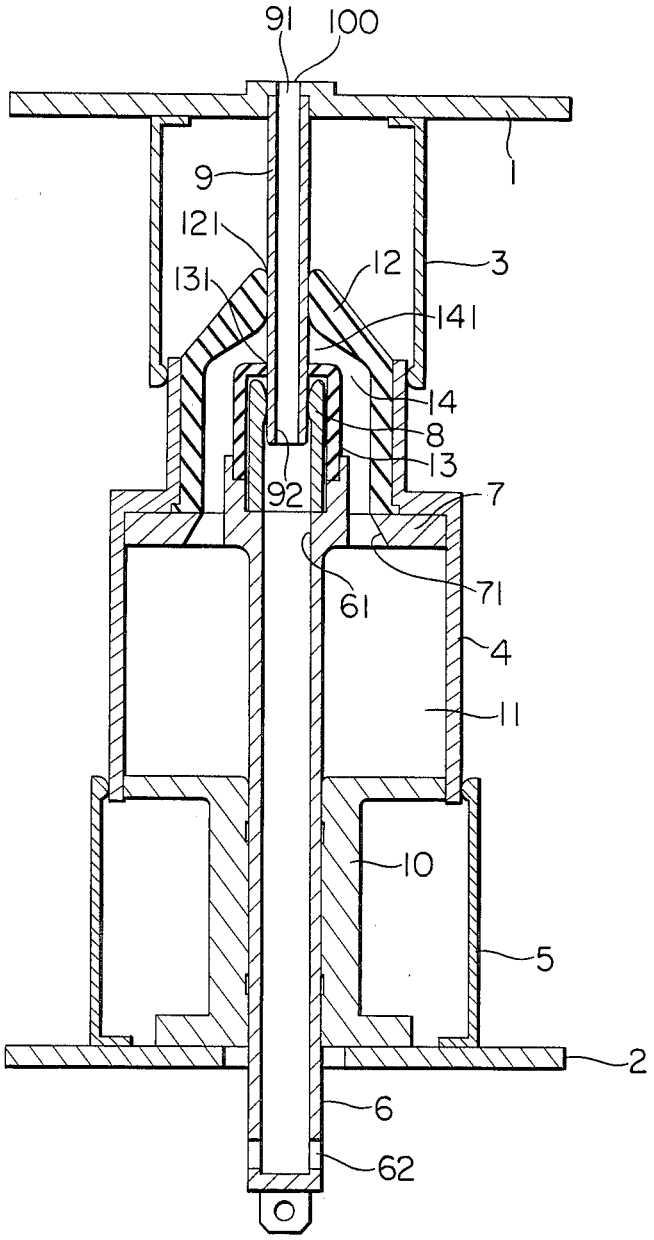
FIG. 1a PRIOR ART
FIG. 1*a* is a sectional front view of a prior-art, puffer type gas circuit breaker in the state in which its contacts are closed.
Figure 1B:
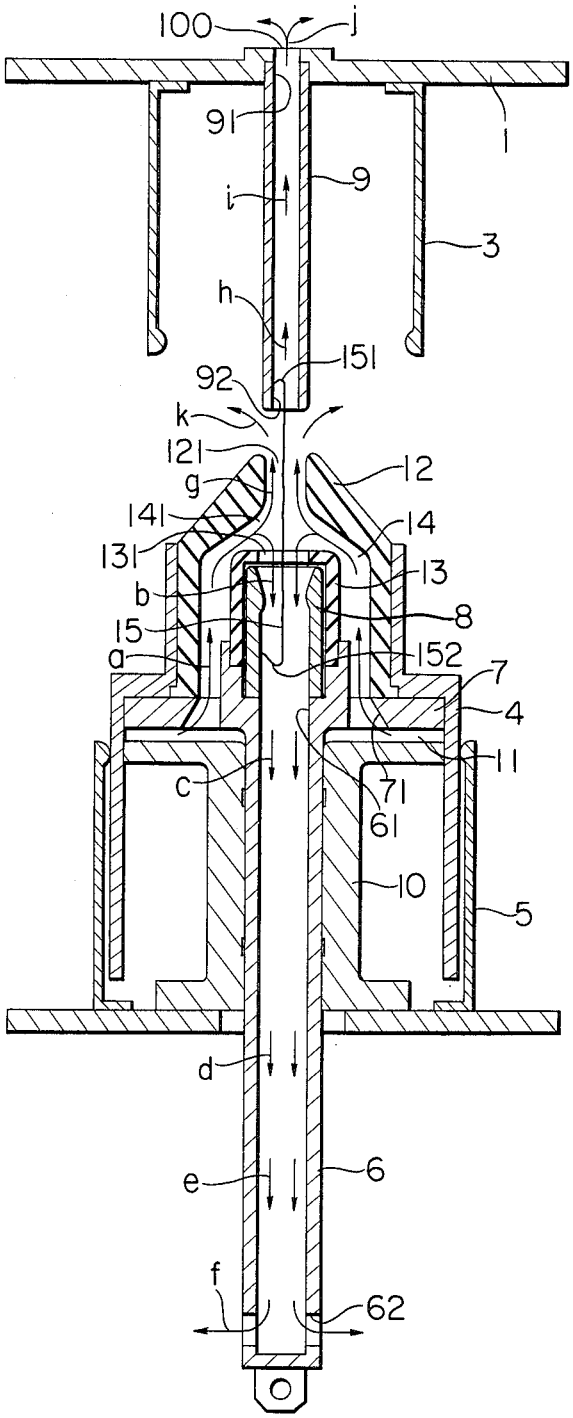
FIG. 1b PRIOR ART
FIG. 1*b* is a sectional front view of the circuit breaker in FIG. 1*a* in the state in which its contacts are opened.
Figure 2:
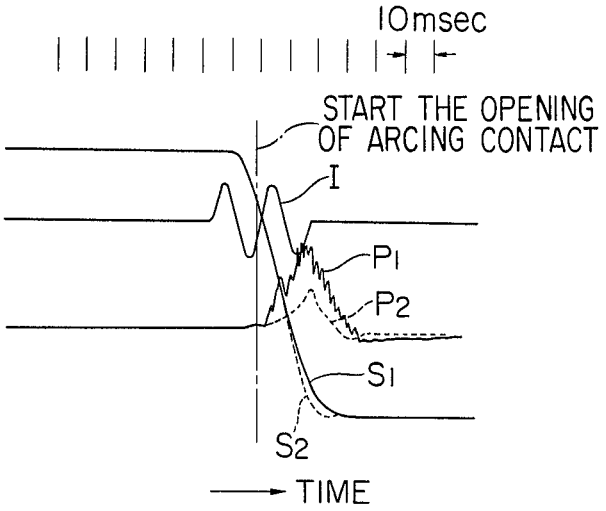
FIG. 2 is a diagram for comparing and explaining the characteristics of the puffer type gas circuit breaker in the case of opening the contacts in no-load and loaded states.
Figure 3A:
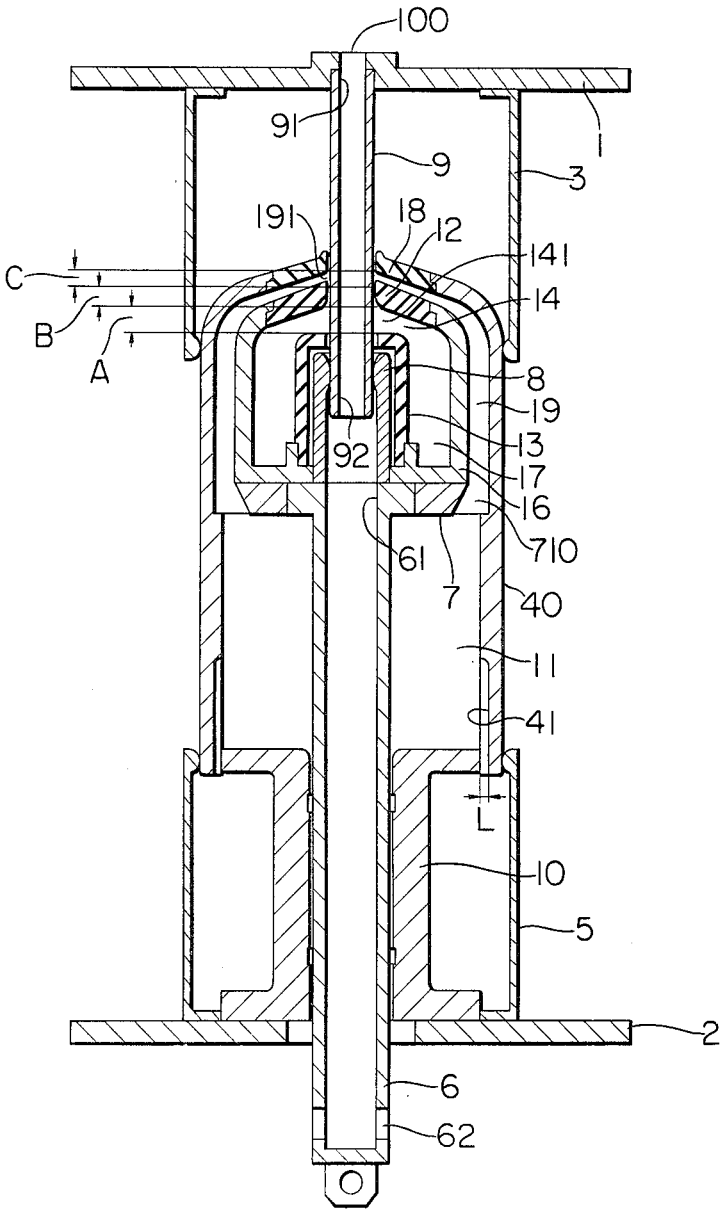
FIG. 3*a* is a sectional front view of a puffer type gas circuit breaker embodying the present invention in the state in which its contacts are closed.
Figure 3B:
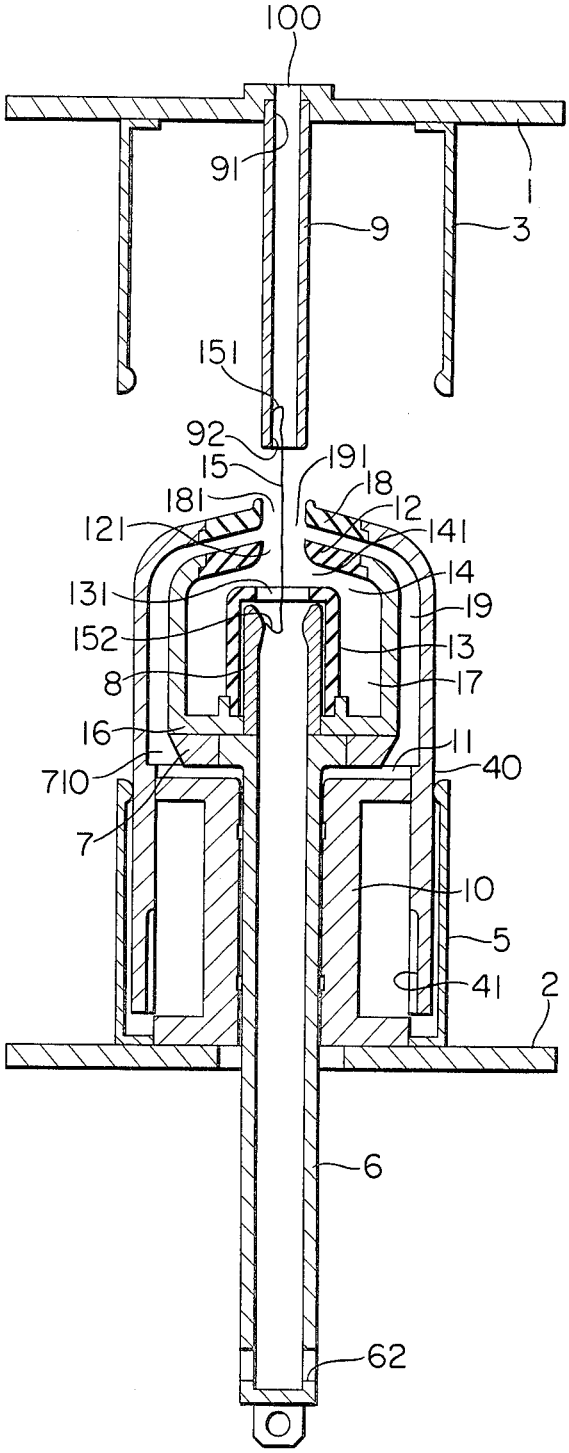
FIG. 3*b* is a sectional front view of the circuit breaker in FIG. 3*a* in the state in which its contacts are opened.

An embodiment of the present invention will now be described with reference to FIGS. 3*a* and 3*b* . In these figures, reference numerals 1–3, 5–15, 61, 62, 91, 92, 121, 131, 141, 151 and 152 denote like parts to those in the prior art, respectively. Numeral 16 indicates a movable body member, one end of which is fixed to the supporter 7 and at the other end of which are juxtaposed the coaxial and concentric nozzle-like fluid guides 12, 13 made of an insulating material such as teflon and the movable arc contact 8. Numeral 40 indicates a puffer cylinder which serves also as a current-carrying movable contact, and which is fixed to the supporter 7. The puffer cylinder 40 has a fluid guide 18 fixed to its end on the power supply terminal side. A fluid passage 19 is defined by the fluid guides 12, 18, the puffer cylinder 40 and the movable body member 16. Radial communicating holes 710 are formed in the supporter 7. An arc extinguishing fluid of low temperature in the puffer chamber 11 circulates through the passage 19 via the communicating holes 710 and becomes a high speed gas stream, which is forcibly blown against the electric arc 15 from a nozzle 191. Shown at numeral 17 is a gas storage chamber for storing the arc extinguishing fluid, which is defined by the movable body member 16, the fluid guides 12, 13, the movable arc contact 8, and the stationary arc contact 9 during the closure of the contacts. The nozzle 141, which is defined by the fluid guides 12 and 13, communicates with the gas storage chamber 17 through the passage 14. The puffer cylinder 40 formed with a stepped part 41 on the load terminal side, so that a clearance L is formed between the puffer piston 10 and the puffer cylinder 40 in the closed state and down to an intermediate point in the course of establishing the open contact state, no puffer action being effected in the stroke down to the intermediate point, wherein the clearance L is not closed and consequently the puffer action is not effected during the contact opening operation till the puffer cylinder reaches the intermediate point.

Now, the interrupting operation of the circuit breaker of the embodiment will be described. First, the arc extinguishing principle of the present invention will be explained. The phenomenon of "arc-back" which has been the drawback of the prior art as described before is positively utilized, that is, the high temperature fluid near the arc striking part attributed to the thermal energy emission of the arc is caused to flow back into the gas storage chamber and mixed with the low temperature fluid contained therein. The fluid pressure in the gas storage chamber is raised, whereby the fluid at a temperature low enough to extinguish the arc is blown against the arc to effect self-extinction in the process in which current decreases toward its zero point, while the low-temperature arc extinguishing fluid from the puffer chamber is forcibly blown against the arc to effect forcible extinction in the process in which the current decreases toward its zero point. Owing to this extinction principle, it is possible to reduce the required operating drive force in the prior-art puffer type circuit breaker, which was due to the pressure rise in the puffer chamber attributed to the "arc-back" or the "containment phenomenon" stated before.

The interrupting operation of the present invention will be explained hereinafter.

Figure 4:
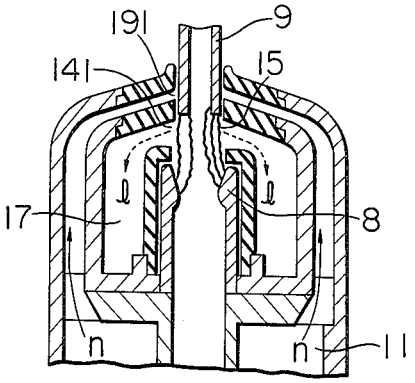
FIG. 4 is a fragmentary sectional front view for explaining the flow of an arc extinguishing fluid at the time at which the contacts of the circuit breaker in FIG. 3*a* are opened.
Figure 5:
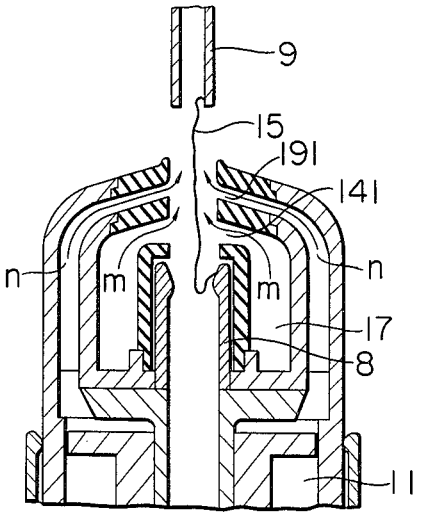
FIG. 5 is also a fragmentary sectional front view for explaining the flow of the arc extinguishing fluid at the time at which the contacts of the circuit breaker in FIG. 3*a* are opened.
Figure 6:
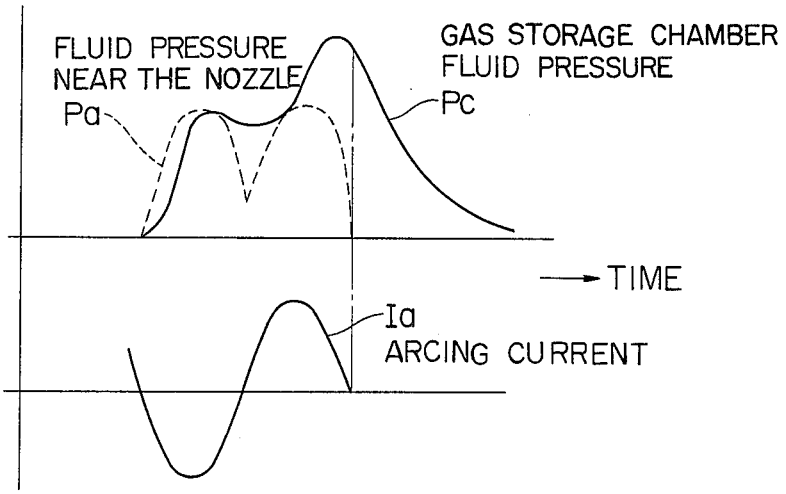
FIG. 6 is a characteristic curve diagram for explaining the situation of pressures in a puffer chamber and near the nozzle of a gas storage chamber in the circuit breaker in FIG. 3*a;*

When the rod 6 descends, the current-carrying movable contact 40 is first disengaged from the current-carrying stationary contact 3. The movable arc contact 8 is subsequently disengaged from the stationary arc contact 9, so that the electric arc 15 develops across the movable arc contact 8 and the stationary arc contact 9. The arc 15 is extended downward with the descent of the movable arc contact 8. Herein, the arc extinguishing fluid near the arc is turned into a high temperature fluid due to the emission of the thermal energy of the arc. As indicated by arrows l in dotted lines in FIG. 4, the high temperature fluid flows backward into the gas storage chamber 17 and mixes with a low temperature fluid in the gas storage chamber 17. Thus, the fluid pressure in the gas storage chamber 17 rises as indicated by a curve $P_c$ in FIG. 6. The arc extinguishing fluid in the gas storage chamber 17 is thus rendered high in pressure, and is rendered low in temperature sufficiently to extinguish the arc. In the process in which current decreases toward its zero point, the pressure of a fluid near the nozzle 141 decreases as indicated by a curve $P_a$ in FIG. 6, so that the fluid pressure in the gas storage chamber 17 becomes higher than the fluid pressure near the nozzle 141. Accordingly, the low-temperature arc extinguishing fluid in the gas storage chamber 17 is blown toward the arc 15 as indicated by arrows m in FIG. 5, whereby the self-extinguishing interruption is effected. On the other hand, regarding the puffer plast, at the initial stage of a contact opening operation, the puffer action is not effected because the clearance L is formed between the puffer piston 10 and the puffer cylinder 40. The puffer action begins to become effective midway of the contact opening operation, and the force thereof increases toward its maximum value in the process in which the current decreases toward its zero point. As a result, the fluid is forcibly blown against the arc 15 as indicated by arrows n in FIG. 5, whereby the forcible arc extinction is effected. In this manner, the thermal energy possessed by the arc is caused to flow backward into the gas storage chamber 17 as much as possible, the backward flow thereof from the nozzle 191 via the passage 19 into the puffer chamber 11 is suppressed, and the thermal energy is consumed by converting it into the energy of the self-extinction, whereby the increase of the operating drive force due to the "arc-back", which is the disadvantage of the prior art, can be reduced. To this end, it is also one expedient to make the dimension A of the nozzle 141 and the dimension B of the fluid guide 12 large and the dimension C of the nozzle 191 small as indicated in FIG. 3*a*.

Needless to say, a circuit breaker must have the function of interrupting a large range of currents which cover, not only short-circuit currents, but also regular load currents as well as, small currents such as exciting current of transformers, the charging current of capacitors, etc. The self-extinction included in the arc extinguishing principle of the present invention does not cover all the different ranges of currents.

Important in the self-extinguishing system is that, in mixing a high temperature fluid heated by the heat emission of an arc and a low temperature fluid in a gas storage chamber, a more excellent arc-extinguishing performance is attained as a lower temperature fluid and a higher pressure rise is produced. To this end, a proper volume of the gas storage chamber 17 needs to be secured, depending upon the magnitude of current to be interrupted. In addition, it is advisable that the function of self-extinction is demonstrated in the higher current interrupting region, with the intention of reducing the load increase of the operating mechanism described before, and hence, the volume of the gas storage chamber 17 is designed to permit the interruption of higher current values. At this time, however, when the small or medium current region is to be interrupted, the thermal energy of the arc is low, so that a pressure rise sufficient for the interruption cannot be attained in the gas storage chamber 17. In contrast, the circuit breaker of the present invention can interrupt the small and medium current regions because it has the function of the forcible arc extinction as described before, that is, the function of extinguishing the arc by causing the arc extinguishing fluid to flow from the puffer chamber 11 via the passage 19 to the nozzle 191 and blowing it against the arc 15 from the nozzle 191. In the present invention, accordingly, the function of the self-extinction which positively utilizes the arc-back phenomenon is utilized for high current interruption, and the function of the forcible extinction which utilizes the puffer action is utilized for medium and small current interruption. In the prior-art circuit breaker, the higher current interruption has required a larger driving force which was due to the increase in operating drive force ascribable to the arc-back phenomenon, whereas in the circuit breaker of the invention, it is effected by the self-extinction. Consequently, a relatively small driving force suffices, and only a comparatively small driving force based on the puffer action for medium and small current interruption is required, whereby the driving force of the circuit breaker can be sharply reduced. Moreover, in a circuit breaker, a rapid operation of opening the contacts is necessary, while at the same time a rapid operation of stopping the contact opening operation is indispensable. In order to execute the stopping operation rapidly and smoothly, a damper (shock absorber) is disposed in a driving mechanism portion. In the prior-art puffer type circuit breaker, the enormous puffer force (energy) which is much greater than the inertial energy of the movable mechanism portion has been necessary for the large current interruption, and hence, it has been impossible to assign the above function of the damper to the puffer action. In contrast, in the circuit breaker of the present invention, the force (energy) of the puffer action may be small, and hence, the function of the damper can be assigned to the puffer chamber 11.

The circuit breaker of the present invention has both the self-extinguishing action and the puffer forcible extinguishing action. Especially for large current interruption, therefore, the electrically-conductive gas of high temperature which stays and remains around the movable and stationary arc contacts even after the self-extinction of the arc, is expelled into the container by the puffer action, whereby the insulation between the electrodes is rapidly recovered.

In the present invention, any structure other than the current-carrying stationary contact 3 exists in the ambient space between the arc contacts, the high-temperature and electrically-conductive gas is smoothly and rapidly expelled into the container without staying around the arc contacts midway. It is therefore possible to attain excellent interrupting characteristics with which the flashover between the arc contacts attributed to multiple thunder, etc. do not easily occur.

In the above embodiment, the puffer type gas circuit breaker of bidirectional blast has been exemplified. Needless to say, in case of unidirectional blast, the communicating holes 62 in FIGS. 3*a* and 3*b* may be closed, or the rod 6 may be made solid.

Figure 7A:
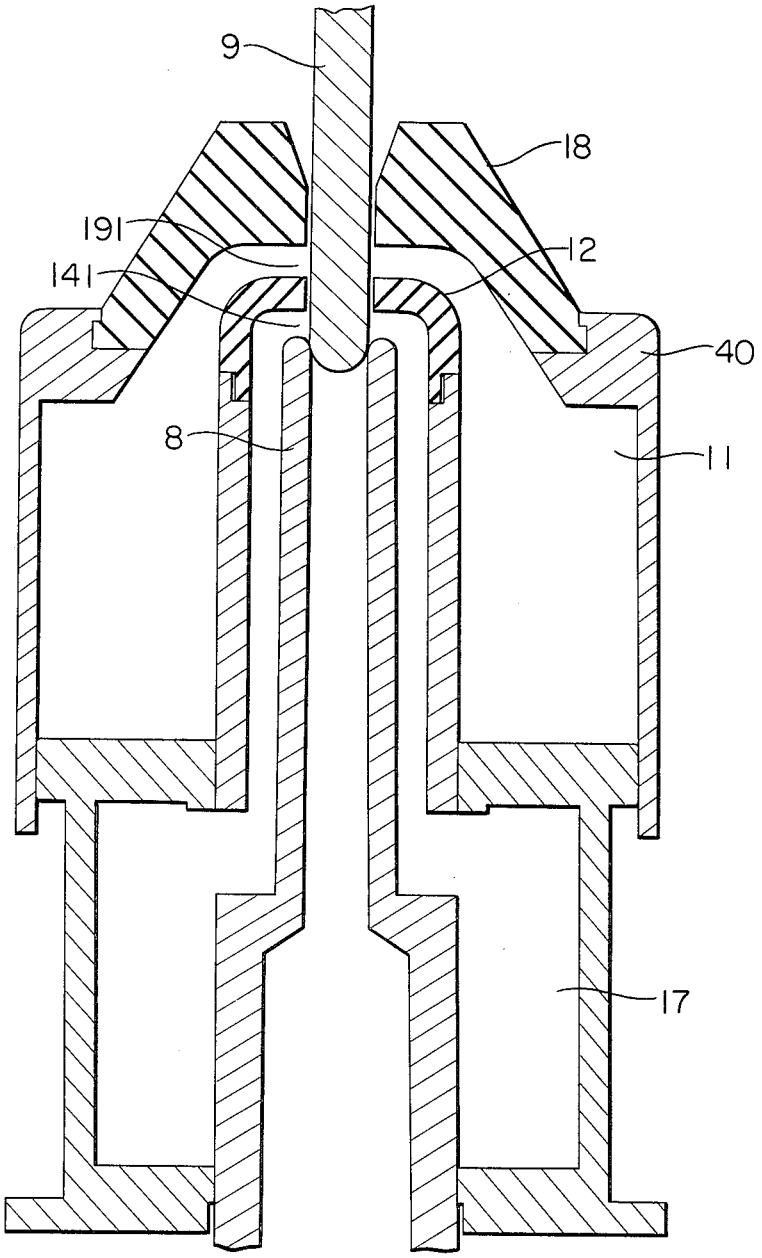
FIG. 7*a* is a sectional front view of a puffer type gas circuit breaker in another embodiment of the present invention in the state in which its contacts are closed.
Figure 7B:
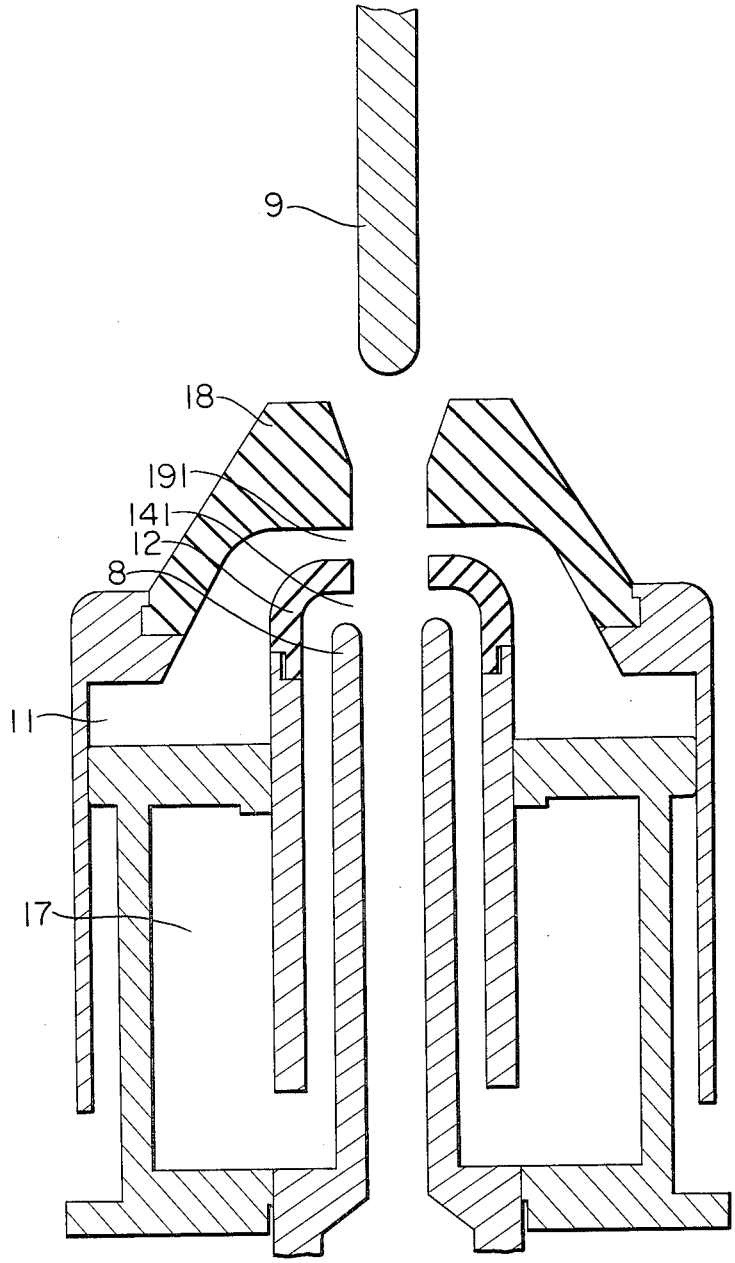
FIG. 7*b* is a sectional front view of the circuit breaker in FIG. 7*a* in the state in which its contacts are opened.

FIGS. 7*a* and 7*b* show another embodiment of this invention, in which the gas storage chamber 17 is arranged in a position distant from the nozzle 141, and the puffer chamber 11 is arranged in proximity to the nozzle 191. With this construction, similar effects are expected.

Figures 8A, 8B:
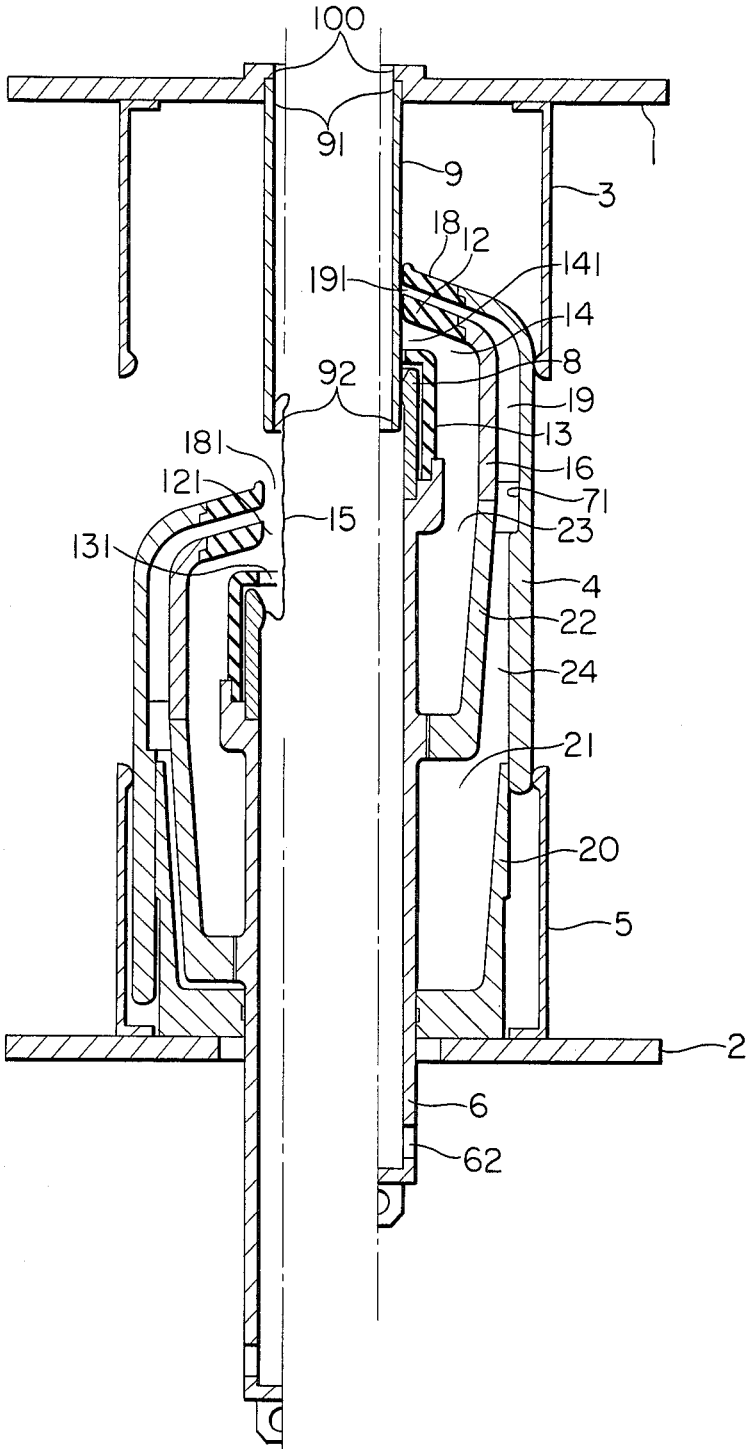
FIG. 8*a* is a half sectional front view showing the right half of a puffer type gas circuit breaker in still another embodiment of the present invention in the state in which the contacts thereof are closed.
FIG. 8*b* is a half sectional front view showing the left half of the circuit breaker in FIG. 8*a* in the state in which the contacts thereof are opened.

Now, FIGS. 8*a* and 8*b* show an embodiment wherein, in order to intensify the foregoing action of self-extinction, a gas storage chamber is constructed in a manner to be insertable in a puffer chamber, and the volume of the gas storage chamber is made large. FIG. 8*a* is a halfcut sectional view showing the closed contact state of the circuit breaker according to this embodiment, while FIG. 8*b* is a halfcut sectional view showing the open contact state thereof. Referring to the figures, numeral 20 designates a bearer which bears the rod 6 and defines the puffer chamber 21 around the rod 6, and the puffer cylinder 4 is slidable on the outer periphery of the bearer. Numeral 22 designates a partition wall which is fixed to the rod 6 in a manner to be insertable in the puffer chamber 21, and which defines the gas storage chamber 23 around the rod 6. When the partition wall 22 is snugly inserted in the puffer chamber 21, the passage 24 having a predetermined interspace is defined between bearer 20 and the partition wall 22, and the puffer chamber 21 and the nozzle 191 are brought into communication the passage 24.

Accord to the above construction, in disengaging both the contacts 8 and 9, when the rod 6 is driven downward as viewed in the figures, both the contacts 3 and 4 are disengaged, whereupon both the are contacts 8 and 9 are disengaged to initiate the electric arc 15. The fluid near the arc having become high in temperature enters the gas storage chamber 23 through the passage 14 and mixes with the low temperature fluid in the gas storage chamber 23.

Meanwhile, as the contact opening operation proceeds, the partition wall 22 defining the gas storage chamber 23 is snugly inserted in the puffer chamber 21, so that the fluid of the puffer chamber 21 has its pressure raised and flows out through the passage 24. The other operations are the same as in the embodiment of FIGS. 3*a* and 3*b*.

Accordingly to this embodiment, the gas storage chamber is constructed in a manner to be snugly insertable the puffer chamber, and the fluid in the puffer chamber compressed by the wall of the gas storage chamber, whereby the volume of the gas storage chamber can be increased, so that the interrupting performance can be enhanced without increasing the operating drive force.

1. A puffer type gas circuit breaker including a puffer chamber and a gas storage chamber and comprising:

a stationary contact and a movable contact for carrying current;

a stationary arc contact and a movable arc contact which are disengaged after opeining of the current-carrying contacts;

a first nozzle and a second nozzle which are juxtaposed along a moving path of said movable arc contact;

an arc extinguishing fluid in said puffer chamber being compressed in accordance with the disengaging movement of said movable arc contact, said arc extinguishing fluid being blown through said first nozzle against an electric arc struck at the time of the disengagement of said arc contacts;

said gas storage chamber being separate from said puffer chamber which communicates with said second nozzle; and an arc extinguishing fluid in said gas storage chamber, a passage opened by the disengaging movement of said moveable arc contact to connect said fluid in said gas storage chamber with the fluid blown through said first nozzle for mixing said fluid, the mixed arc extinguishing fluid being blown through said second nozzle against the electric arc after said movable arc contact has moved a predetermined distance.

2. A puffer type gas circuit breaker according to claim 1, wherein said gas storage chamber communicating with said second nozzle is disposed in a manner to surround said movable arc contact, and said puffer chamber communicating with said first nozzle is disposed around said gas storage chamber.

3. A puffer type gas circuit breaker according to claim 1, wherein said second nozzle juxtaposed to said first nozzle along said moving path of said movable arc contact has an opening area which is larger than an opening area of an outlet of said first nozzle.

4. A puffer type gas circuit breaker according to claim 1, wherein the arc extinguishing fluid in said puffer chamber is compressed after said movable arc contact has moved a predetermined distance.

5. A puffer type gas circuit breaker according to claim 1, wherein said gas storage chamber has an internal space volume which is larger than a space volume of an outlet thereof.

* * * * *